US006155551A

United States Patent [19]

Russ et al.

[11] Patent Number: 6,155,551

[45] Date of Patent: Dec. 5, 2000

[54] RECIPROCATING STACKER FOR CONTINUOUS STRIP MATERIAL

[75] Inventors: Michael J. Russ, Avon Lake; Reinder Mulder, Stow; Douglas R. Holt, Canfield, all of Ohio

[73] Assignee: VMI Americas, Inc., Stow, Ohio

[21] Appl. No.: 09/195,244

[22] Filed: Nov. 18, 1998

Related U.S. Application Data

[60] Provisional application No. 60/068,168, Dec. 19, 1997.

[51] Int. Cl.[7] ..... B65H 45/20

[52] U.S. Cl. ..... 270/30.01; 493/413; 414/792.2

[58] Field of Search ..... 270/30.01, 30.09, 270/39.01, 39.05; 414/791.2, 792.2, 788.6, 789.8, 792; 19/160, 163; 493/413, 414, 415

[56] References Cited

U.S. PATENT DOCUMENTS

| | | | |
|---|---|---|---|
| 512,443 | 4/1894 | Kershaw | 19/163 |
| 2,050,053 | 8/1936 | Graf et al. . | |
| 2,761,678 | 9/1956 | Cohn et al. | 493/413 |
| 3,770,264 | 11/1973 | Sturman et al. | 493/413 |
| 3,913,904 | 10/1975 | Occhetti . | |
| 4,074,901 | 2/1978 | Catallo | 493/413 |
| 4,425,109 | 1/1984 | Konsti et al. | 493/413 X |
| 5,005,335 | 4/1991 | Yourgalite et al. | 53/399 |
| 5,087,140 | 2/1992 | Keeton et al. . | |
| 5,106,358 | 4/1992 | Meschi | 493/415 |
| 5,139,247 | 8/1992 | Meschi . | |
| 5,423,733 | 6/1995 | Adachi | 492/414 |
| 5,445,493 | 8/1995 | Yourgalite et al. . | |
| 5,529,564 | 6/1996 | Hediger . | |

FOREIGN PATENT DOCUMENTS

| | | |
|---|---|---|
| 3836974 | 5/1990 | Germany . |

*Primary Examiner*—Christopher P. Ellis
*Assistant Examiner*—Patrick Mackey
*Attorney, Agent, or Firm*—Richard C. Litton

[57] ABSTRACT

A reciprocating stacker for relatively narrow, thin, and flexible continuous strip material provides for the stacking of such material in evenly distributed layers on a pallet or the like. The machine includes a distribution or feeder head which receives the strip material from a conveyor and distributes it evenly on the pallet. The head reciprocates or oscillates in a first direction to lay the material out in a zig-zag or accordion fold configuration, while simultaneously translating in a second direction normal to the first direction, to distribute the material evenly laterally across the surface. When a complete layer has been formed, the machine turns the pallet by ninety degrees so the orientation of the next layer is normal to the orientation of the immediately underlying layer. The process continues, with the feeder head being raised to maintain a substantially constant distance between the head and the underlying surface, until the stack is completed. The present stacking machine is particularly useful in the handling of essentially continuous strips of rubber in an intermediate production step in the manufacture of tires and other products using rubber, but is also useful in the palletizing of virtually any relatively thin, narrow, and flexible continuous strip material.

20 Claims, 3 Drawing Sheets

RECIPROCATING STACKER FOR CONTINUOUS STRIP MATERIAL

REFERENCE TO RELATED PATENT APPLICATION

This application claims the benefit of U.S. Provisional Patent Application Ser. No. 60/068,168, filed on Dec. 19, 1997.

BACKGROUND OF THE INVENTION

1. Field of the Invention

The present invention relates generally to robotic material handling devices and the like, and more specifically to a machine for stacking a relatively thin and narrow strip of flexible material on a pallet. The machine provides reciprocating action in three mutually orthogonal axes to stack the material to a predetermined width, depth, and height or weight on a pallet or the like.

2. Description of the Related Art

Rubber and other flexible, resilient materials are often formed into relatively thin and narrow elongate strips during an intermediate step of manufacture, for transport and storage prior to modification or manufacture into finished goods (tires, etc.). These strips may be hundreds of feet long, and are often stacked and stored on a conventional pallet of perhaps four feet by four feet in width and depth.

Heretofore, the stacking of such continuous strip material has been done by hand, a task that is boring in its extreme and obviously also extremely labor intensive. While relatively low paid workers are used for such tasks, the salaries and fringe benefits (worker's compensation, etc.) which must be provided, add up to a significant cost for this production step.

Accordingly, a need will be seen for an automated, robotic machine which is capable of accepting such essentially continuous strip material, and handling the material to stack it in a sinusoidal pattern of increasing height on a pallet, to a predetermined height or weight. The machine must be capable of performing the chore with very little human assistance, with such assistance basically comprising the initial feeding of material into the machine and starting the machine as required. All other functions of the machine should be automated for optimum efficiency and consistency in loading the pallets. A discussion of the related art of which the present inventors are aware, and its differences and distinctions from the present invention, is provided immediately below.

U.S. Pat. No. 2,050,053 issued on Aug. 4, 1936 to Julius E. Graf et al., titled "Strip Handling," describes a machine through which a strip of thin, flexible sheet metal passes on rollers. A weighted takeup is provided, so that when the movement of the sheet metal strip is momentarily stopped downstream of the machine, production of the metal strip may continue upstream of the machine with the takeup taking up the metal strip between the production and the stopped portion. The Graf et al. machine cannot stack the material, nor can it turn the material to stack it laterally across an axis normal to a first stacking axis. Also, no automated turning or shutoff is provided by Graf et al., all of which are provided in the present invention.

U.S. Pat. No. 3,913,904 issued on Oct. 21, 1975 to Louis Occhetti, titled "Stacking Machine For Rubber Or The Like Sheet Material," describes a frame with an elevator for adjustably lifting a pallet vertically below the sheet material feed means of the machine. The majority of the disclosure is directed to a machine which cuts off substantially identical lengths of sheet material and lays and stacks each length on the pallet, which is slowly lowered to maintain the same vertical distance between the feed rollers and the top of the stack on the pallet. A portion of the disclosure provides for the continuous feeding, folding, and stacking of a continuous, uncut sheet of material, but no means is provided by Occhetti to arrange alternating layers transversely to one another, as provided by the present machine. This is because the Occhetti machine provides only for the stacking of relatively wide sheet material, rather than the relatively narrow strip material provided for by the present invention. Accordingly, the Occhetti machine cannot provide for lateral movement of the sheet material feeder means, as the width of the sheet material being stacked is substantially equal to the width of the pallet. The present stacking device translates the relatively narrow strip laterally across the width of the pallet during each layer of the stacking operation, to lay the relatively narrow strip evenly across the entire pallet. Moreover, the present machine also provides for the rotation of the pallet for laying each subsequent layer transverse to the layer below for a sturdier and more durable stack, which capability is not needed by the Occhetti machine.

U.S. Pat. No. 5,087,140 issued on Feb. 11, 1992 to J. Herbert Keeton et al., titled "Festooning Machine For Cloth Strips," describes a pneumatically driven oscillating spreader, which reciprocates to deliver the cloth strip in a sinusoidal stack atop a pallet or the like. As the strip is relatively narrow, Keeton et al. provide lateral movement in order to distribute the strip more or less evenly across the pallet. However, Keeton et al. oscillate the pallet laterally to accomplish this, rather than moving the feeder means laterally, as is done with the present invention. Moreover, no means is disclosed to adjust the mechanism to allow for the variation in height of the stack as the stack is built up, nor for the rotation of the pallet in order to allow alternating layers to be built up transversely to one another, as provided by the present invention.

U.S. Pat. No. 5,139,247 issued on Aug. 18, 1992 to Luciano Meschi, titled "High Speed Folding Machine For Elastic Material Bands," describes a machine having a pair of spaced apart rollers which alternatingly pinch the material between each roller and an adjacent fixed structure. The result is an accordion folded material which is stacked beneath and between the rollers. As in the case of the U.S. '904 Patent to Occhetti, the material being handled is relatively wide, so there is no need to provide for lateral positioning of the material in the stack, as in the present invention. Also, no means of rotating the stack to provide for transverse layer orientation is provided by the Meschi machine, as is provided in the present invention.

U.S. Pat. No. 5,445,493 issued on Aug. 29, 1995 to Ray A. Yourgalite et al., titled "Apparatus For Palletizing/Unitizing Easily Compressible Products," describes a machine having input and output conveyors at right angles to one another. A "hand assembly" comprising a series of orthogonally disposed open gates, is used to grasp the material about its edges and lift each layer, so another layer may be placed therebelow. The material being handled must therefore be relatively rigid, as the flexible strip material palletized by the present invention, could not be handled by the Yourgalite et al. machine. Moreover, the Yourgalite et al. machine cannot handle continuous strip material, but is only equipped to handle discrete sections or pieces of material.

Finally, U.S. Pat. No. 5,529,564 issued on Jun. 25, 1996 to Hanspeter Hedinger, titled "Apparatus For Depositing, Guiding And Pressing Material Web Parts To Be Stacked,"

describes a device having means for grasping or holding each edge of a zig-zag or accordion folded material as it is being folded and stacked. However, the Hedinger machine is only adapted for use with relatively wide sheet material, and no means is provided to translate the mechanism laterally to arrange relatively narrow strip material evenly across a pallet, as in the present invention. The present machine provides for movement of the feed mechanism in three mutually orthogonal axes, unlike the Hedinger or other machines described.

None of the above inventions and patents, taken singly or in combination, is seen to describe the instant invention as claimed.

SUMMARY OF THE INVENTION

The present invention comprises a reciprocating stacker for relatively narrow, thin, and flexible continuous strip material. The machine is an essentially robotic, automated device, and is particularly well adapted for palletizing continuous strips of rubber in an intermediate stage of production, for use in tire manufacture. However, the present machine will be seen to be useful in the stacking and palletizing of other materials having a similar configuration, as well.

The present reciprocating stacking machine includes a reciprocating strip feeding head, which oscillates fore and aft to lay a continuous strip of material in a zig-zag or accordion fold fashion on a pallet or the like. The feeding head is also moved laterally as the zig-zag buildup of the strip material is laid down, to distribute the relatively narrow strip of material evenly across the entire surface. When a complete layer of material has been deposited evenly over the underlying surface, the pallet is turned ninety degrees, so the next layer is oriented at right angles to the underlying layer. As each layer is built up, the feeder head is raised slightly to maintain the same distance between the head and the underlying surface upon which the strip material is being deposited. The process continues as multiple layers are built up, until the pallet is completely loaded. Thus, the feeder head component of the present reciprocating stacker automatically adjusts its position in three mutually orthogonal axes to deposit the material evenly over the underlying surface.

Accordingly, it is a principal object of the invention to provide an improved reciprocating stacking machine for the stacking of relatively thin, narrow, and flexible continuous strip material, which machine provides for the automated palletizing or stacking of the continuous strip in an evenly distributed stack to a predetermined height or weight as desired.

It is another object of the invention to provide an improved reciprocating stacker which stacks strip material with the lengths of the material in alternating layers being normal to one another.

It is a further object of the invention to provide an improved reciprocating stacker including means for turning a partially completed stack ninety degrees at the completion of the formation of each layer, thereby causing the next layer to be disposed ninety degrees to the underlying layer of material.

An additional object of the invention is to provide an improved reciprocating stacker including a feeder head which is translatable in three mutually orthogonal axes, to distribute the material evenly longitudinally and laterally across a pallet or the like, and to maintain the head at a substantially constant height above the underlying surface.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a reciprocating stacking machine, for the stacking of elongate, flexible, continuous strip material on a pallet or the like. The present machine is particularly adapted for the stacking of rubber or other elastomer strip material, as handled during an intermediate processing step in the manufacture of tires and other rubber articles.

Figure 1:
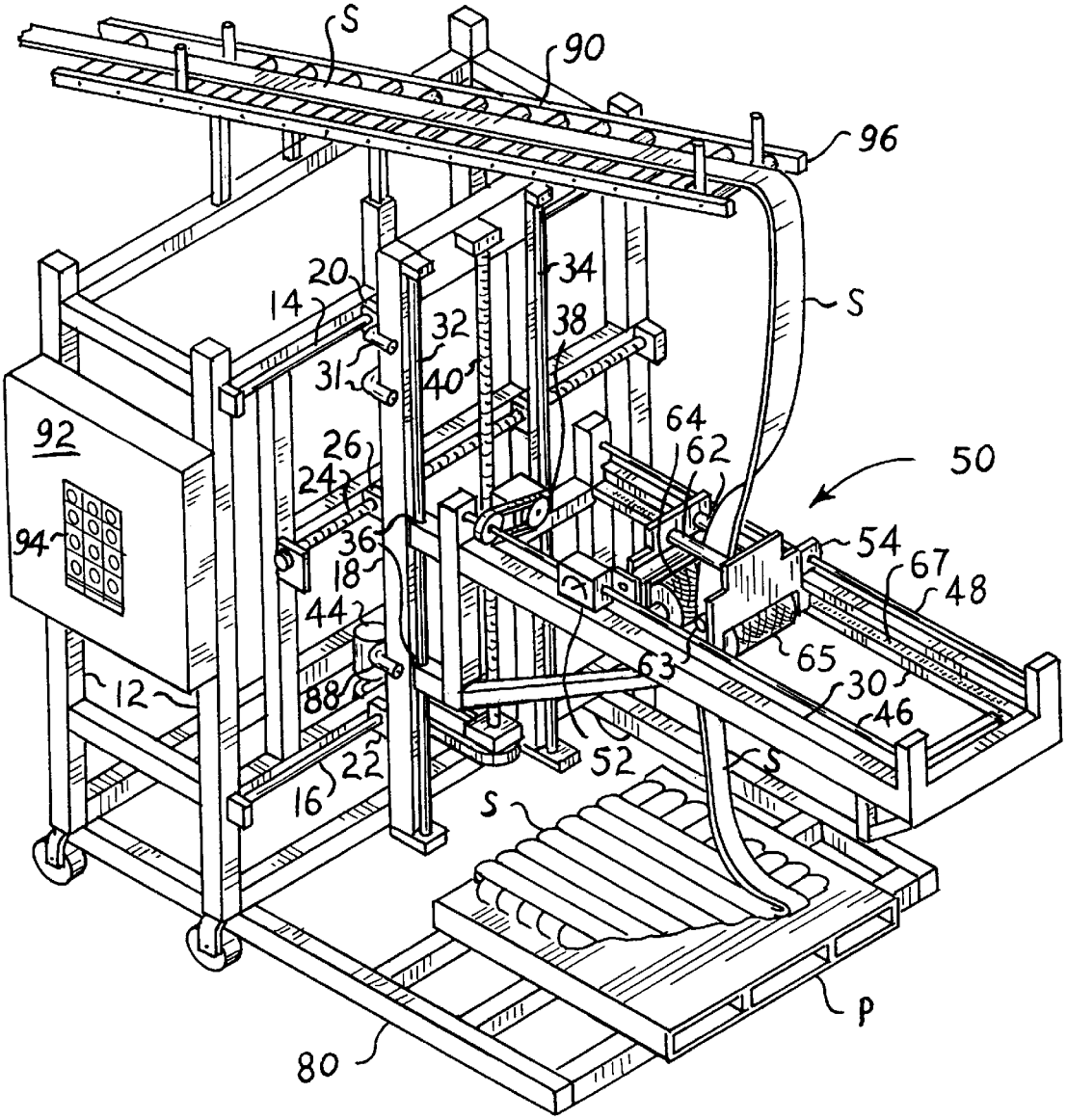
FIG. 1 is a perspective view of the present reciprocating stacker machine, showing its general configuration and operation.

The present stacking machine 10 is shown partially or completely in each of the drawing figures, with FIG. 1 providing a perspective view of the entire machine 10. The moving components of the present machine 10 extend from a stationary, generally vertical first frame 12, preferably constructed of a sturdy structural material such as steel rectangular tubing, angle, channel, or I beams or the like. The first frame 12 provides cantilever support for the remaining movable and reciprocating structure of the present machine 10.

The first frame 12 includes spaced apart upper and lower lateral slides or guides, respectively 14 and 16, which support a generally vertical, laterally reciprocating second frame 18 by upper and lower bearing ears or lugs, respectively 20 and 22, extending from the second frame 18. A second frame drive mechanism also extends across the first frame 10 to engage the second frame 18 and drive the second frame 18 laterally back and forth with respect to the first frame 12. The second frame drive mechanism may comprise a screw jack 24 extending laterally across the front of the first frame 12, which engages mating threaded attachments 26 on the second frame 18. The screw jack 24 may be powered by an electric motor 28 (shown in FIG. 2) installed on the first frame 12. Other drive means, e.g., rack and pinion gears, pneumatic or hydraulic rams or struts, etc., may be used alternatively as desired.

The generally horizontal third frame 30 extends forwardly from the second frame 18, as shown in the drawing figures. The third frame 30 generally comprises a pair of spaced apart structural members similar to those used in the construction of the stationary first frame 12, i.e., steel rectangular tube, angle, channel, or I beam, etc. The third frame 30 reciprocates vertically up and down the front of the second frame 18, by means of a drive mechanism similar to that described above for driving the second frame 18. Limit or proximity switches (e.g., photoelectric cells, microswitches, etc.), such as the switches 31, may be used to limit the motion of the second frame 18 relative to the first frame 12, and the third frame 30 relative to the second frame 18, and to reverse their motions as desired.

The support and drive means for the third frame 30 is similar to that for the second frame 18, but is disposed orthogonally thereto to drive the third frame 30 vertically up and down relative to the second frame 18. The third frame 30 support and drive means comprises a first and a second slide, respectively 32 and 34, disposed vertically in the second frame 18. The third frame 30 includes first and second bearings, respectively 36 and 38, which engage the respective first and second slides 32 and 34 to secure the third frame 30 to the second frame 18 and allow the third frame 30 to slide vertically relative to the second frame 18. The third frame 30 drive means may comprise a screw jack 40, disposed vertically between the two spaced apart slides 32 and 34, with a mating threaded attachment (not shown, but essentially the same as the threaded drive attachment means 26 shown in FIGS. 1 and 2, for driving the second frame 18) engaging the screw jack 40. Again, other means, e.g., rack and pinion, hydraulic or pneumatic rams, etc., may be used alternatively to drive the third frame 30 in its upward and downward travel. A motor 44 is provided to turn the screw jack 40, thereby causing the third frame threaded attachment to be advanced upwardly or downwardly along the front of the second frame 18, depending upon the direction of rotation of the motor 44 and screw jack 40.

Figure 3:
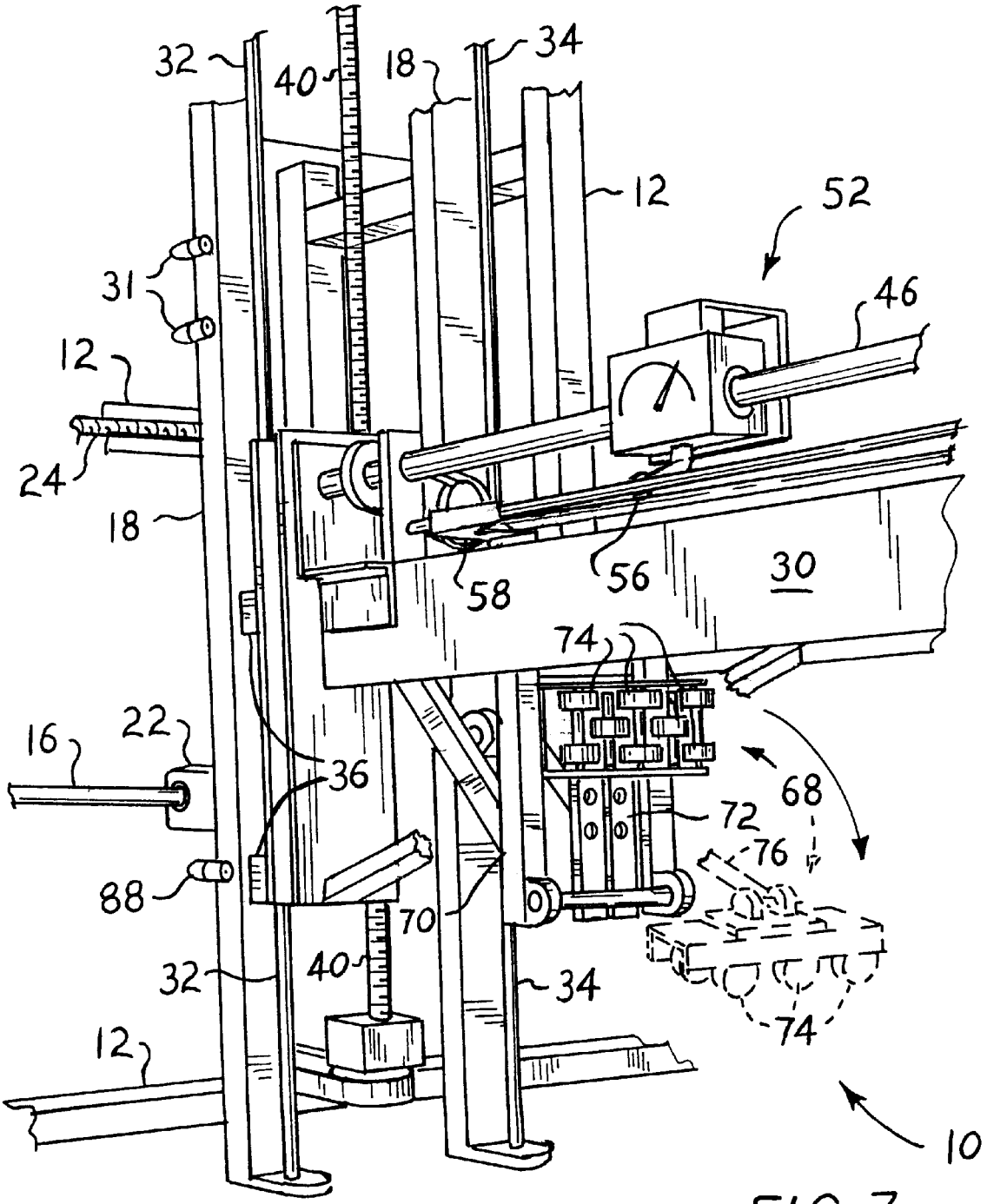
FIG. 3 is a detailed perspective view of the reciprocating stacker, showing further structural details and mechanisms thereof.

The generally horizontally disposed third frame 30 includes spaced apart first and second slide members, respectively 46 and 48, serving to support a stacking guide 50 therebetween on respective bearing members 52 and 54. The first bearing member 52 may comprise a rolling ring drive unit, such as manufactured by Amacoil, Inc., in lieu of a threaded screw jack and cooperating threaded attachment member for driving the stacking guide assembly 50 back and forth along the third frame 30. Other drive means, e.g. screw jacks, hydraulic rams, rack and pinion systems, hydraulic or pneumatic motors, etc., may be used as desired. The rolling ring unit and bearing 52 includes a depending lever 56, which engages a mechanical stop 58 at each end of the slide member 46 as shown in FIG. 3. When the lever 56 engages either of the stops 58, the lever 56 is reversed, causing the rolling ring drive unit to reverse its direction of travel to move the guide assembly 50 in the opposite direction.

The guide 50 includes a pair of upper rollers 62 which serve to receive and guide an elongate material strip S therebetween, for stacking on a pallet P or the like positioned below the guide 50. Another set of lower rollers 63 is disposed orthogonally beneath the upper rollers 62, to orient the relatively flat strip S properly for laying out in orderly rows. Additional opposed first and second pinch rollers, respectively 64 and 65, are rotated downwardly to feed the strip material S therebetween to the underlying pallet P.

Drive means for the feeder rollers 64 and 65 is provided by a toothed rack 67 which extends the length of the third frame 30, with conventional mating pinion gears (not shown) extending from each of the rollers 64 and 65 and engaging the rack 67. Each of the rollers 64 and 65 includes a conventional one way clutch mechanism (sprag, ratchet, etc., not shown), with each of the clutches engaging and releasing in opposite rotational directions to one another. Thus, each of the rollers 64 and 65 will be driven alternatingly to draw the continuous length of strip material S downwardly between the two feeder rollers 64 and 65 during operation of the stacking machine 10, depending upon the direction of movement of the guide or carriage 50 and the corresponding rotation of each of the roller and clutch drive gears.

Figure 2:
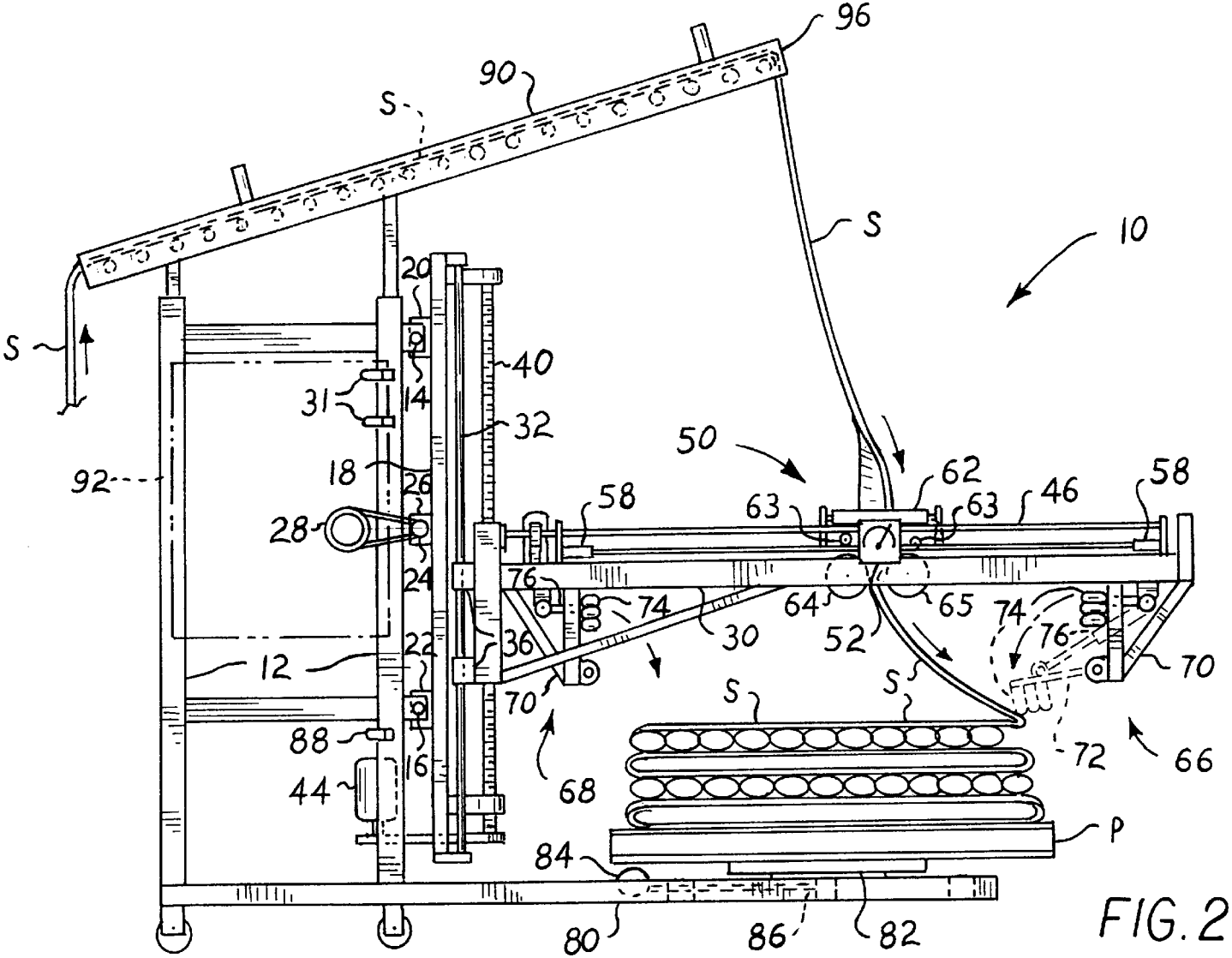
FIG. 2 is a side elevation view of the reciprocating components of the machine, showing further operational details.

The third frame member 30 also includes a first and an opposite second momentary strip retainer, respectively 66 and 68, at the respective opposite first and second ends thereof, as shown in FIG. 2 of the drawings. The strip retainers 66 and 68 serve to hold down the strip material S as it is laid back over itself at one edge of the stack, as the guide 50 reverses its direction of travel in the third frame 30. The strip retainers 66 and 68 are each timed to apply an alternating holding force to the folded edge of the strip material S for a short time as required, and then to release their grip of the material S in order to apply a new hold or grip on the next folded edge as the strip material S is continuously and reciprocatingly laid back and forth to form a stack, somewhat as shown in FIG. 2 of the drawings.

Each of the two strip retainers 66 and 68 is similar in construction, so identical reference characters are used to indicate corresponding components of the two retainers. A detailed view of the second retainer 68 is shown clearly in FIG. 3 of the drawings. Each of the retainers 66 and 68 comprises a diagonally braced frame 70, with an arcuately movable arm 72 pivotally mounted from the lower inward end of the frame 70. Each of the arms 72 is formed of a pair of elongate members, and includes one or more grip members 74 laterally disposed thereon for directly contacting and retaining the strip material S. The arms 72 are actuated by a pneumatic cylinder and strut 76 (or alternatively, a hydraulic cylinder, linear motor, etc.) to swing the arm 72 arcuately upwardly and downwardly as required.

The stationary first frame 12 includes a base 80, formed of a series of sturdy structural members (steel rectangular tubes, I beams, etc.) extending generally horizontally from the first frame 12 and beneath the third frame 30, as shown in FIGS. 1 and 2. A rotary platform 82 is mounted atop the base 80, below the third frame 30. The platform 82 is rotated by a suitable drive motor 84 and chain and sprocket, belt, or other suitable means 86, as shown in FIG. 2. The platform 82 is rotated ninety degrees by the motor 84 and drive 86 at the completion of each layer of the strip material S on the pallet P, so that each successively higher layer of material S is oriented orthogonally to the layer immediately therebelow. This provides for the interlocking of the layers, to form an exceedingly sturdy stack of strip material S which can be transported easily without concern for disintegration or for any need to wrap or otherwise secure the material S on the pallet P.

The present stacking machine 10 operates by accepting a length of continuous strip material S, delivered by an overhead conveyor 90 (roller conveyor, or other suitable conveyor means) to provide continuous delivery of the strip material S to the stacking machine 10. The machine 10 is first set up by placing a pallet P on the rotary platform 82, and positioning the movable second and third frames 18 and 30, the stacking guide 50, and the rotary platform 82, so that the first end of the strip will fall at one corner of the pallet P. This is called the "home" position for the strip stacking machine 10. A control panel 92 containing various electronic controls 94 for the various functions, is provided.

The continuous strip S is delivered by the output end 96 of the conveyor 92, which output end 96 is positioned generally above the stacking guide 50. (It will be understood that the guide 50 will move to distribute the strip material S evenly across the pallet P, and will not remain directly beneath the output end 96 of the conveyor 92 at all times.

The guide and feed rollers 62 and 64 of the stacking guide 50 serve to smooth the delivery of the strip material S at all times, even though the strip material S is passing through the stacking guide 50 at some angle other than vertical.)

As the first end of the strip material S is deposited at one corner of the pallet P by the conveyor 90 and stacking guide 50, the first retainer 66 is actuated to lower the arm 72, thereby holding the first end of the strip material S in position on the pallet P. The rolling ring drive motor 52 is then actuated to travel along the third frame slide member 48, thereby driving the stacking guide or carriage 50 from one end of the third frame 30 toward the opposite end thereof. At this point, the reversing arm 56 of the rolling ring device 52 contacts the drive or guide stop 58 at that end of the travel to reverse the direction of rotation of the rolling ring drive unit 52, thereby sending the stacking guide or carriage 50 in the opposite direction.

As the guide or carriage 50 begins to reciprocate toward its initial position, thereby forming an overlapping fold or loop of the elongate strip material S, the arm 72 of the second momentary retainer 68 is lowered to hold or grip the doubled over looped end of the strip material S, somewhat as shown by the position of the first retainer 66 shown in broken lines in FIG. 2. The opposite second momentary retainer 68 has lifted its arm 72 at this point, in order to remain clear of the pallet P and strip material S thereon as the second and third frames 18 and 30 and guide assembly 50 are shifted laterally by the mechanism of the present stacking machine 10, in order to distribute the strip material S evenly over the surface of the pallet P.

The second and third frames 18 and 30 are moved slightly laterally with each pass of the guide or carriage 50, in order to reposition the guide 50 precisely over the pallet P for even distribution of the strip material S over the pallet P. This is done by actuating the second frame drive motor 28 to turn the screw jack 24 laterally disposed across the first frame 12, thereby moving the second frame 18 (and accordingly, the third frame 30 attached thereto) a predetermined distance laterally. This process is continued until an even layer of the continuous strip material S (actually two layers, resulting from the reciprocating direction of travel of the guide 50) has been deposited evenly over the entire surface of the pallet P.

At the end of the lateral translation of the second and third frames 18 and 30 from one side to the other, the direction of the second frame drive motor 28 and screw jack 24 are reversed, with the continuing operation of the system resulting in another two thicknesses of the strip material S being deposited over the first two thicknesses. The travel of the guide or carriage 50 may be adjusted to produce a slightly shorter pass when the layers are placed in each reciprocating direction, for better stacking of the material atop the same direction underlying layers.

When the second and third frames 18 and 30 have reached their original locations, the stacking machine 10 actuates the platform drive motor 84 to turn the platform 82, and thus the pallet P resting thereon, ninety degrees to its original orientation. This rotation causes the last portion of the strip material S which was deposited, to be dragged across the surface of the underlying layers of material S to lay generally diagonally across the pallet P and underlying layers of material S. The stacking process is then reinitiated, with the guide or carriage 50 reciprocating back and forth in the third frame 30, which in turn and along with the second frame 18, is gradually moved laterally across the front of the first frame 12 to deposit the strip material S evenly across the underlying previously deposited layers, and at a right angle to the immediately underlying layers. This process is shown generally in FIGS. 1 and 2 of the drawings.

As the palletized material S is stacked ever higher in an ever increasing number of layers, the third frame 30 with its guide or carriage 50 must be raised in order to provide an essentially constant distance between the guide 50 and the underlying upper surface of the layered material S for consistent formation of each loop or pass of the material S, and to provide the proper clearance and spacing for the proper operation of the two retainers 66 and 68. Accordingly, an automated sensing means (photoelectric cell 88, or infrared detector or other mechanical, electronic, or optical means) is used to detect the increasing height of the multiple layers of strip material S, and to signal the third frame drive motor 44 to turn the corresponding vertically disposed screw jack 40 within the second frame 18, thereby raising the third frame 30 as required.

The above described process is continued until a stack of strip material S of the desired predetermined height is reached, whereupon a stack height sensing means disposed on the second frame 18 detects the vertical position of the third frame 30 thereon and signals the system to stop. (Alternatively, a load cell or other conventional weight sensing means, not shown, may be installed on the rotary platform 82 to detect the weight of the pallet P and strip material S placed thereon, with a signal being sent to stop the process when a predetermined weight is attained.)

The upper end of the strip material S is then cut at or near the guide 50 and placed atop the underlying layers of material S atop the pallet P. The loaded pallet P is then removed from its position atop the rotary platform 82 by suitable means (forklift, pallet loader, etc.), an empty pallet is placed on the platform 82, and the various frames and elements of the stacking machine 10 are repositioned to their respective "home" positions by means of the control system 92 and panel 94. The stacking machine 10 is then ready for use in loading another pallet with elongate strip material S, in the manner described above.

In summary, the present stacking machine provides a much needed reduction of labor in the stacking or palletizing of elongate, flexible strip material. While the present machine may be used in any number of industries and environments where the stacking of such material is required, it is particularly valuable in the tire and rubber industry where rubber is formed in such elongate strips of material as an intermediate step in the processing and manufacturing of rubber into tires.

The above described operation is preferably electronically controlled by means of suitable sensors, transducers, and the like, which may communicate with a suitable computer program for running the present stacking machine. The present machine thus requires at most a single worker to cut the strip material when a pallet has been completely loaded, and to remove the loaded pallet, install an empty pallet, and initiate operation of the machine to load the freshly placed empty pallet.

The present machine is capable of loading a pallet with a volume on the order of one cubic yard of strip material, or perhaps slightly more, on a four foot by four foot pallet, in only a few minutes of time. The labor savings resulting from the use of the present machine will pay for the machine in very short order in the industry, thus significantly increasing the operational efficiency of manufacturers using the present reciprocating stacking machine.

It is to be understood that the present invention is not limited to the sole embodiment described above, but encompasses any and all embodiments within the scope of the following claims.

We claim:

1. A reciprocating stacking machine, comprising:

a stationary, generally vertically disposed first frame;

a generally vertically disposed, laterally reciprocating second frame extending from said first frame;

a vertically movable third frame extending generally horizontally from said second frame;

a longitudinally reciprocating guide supported by said third frame;

said first frame including generally horizontally disposed base members extending therefrom and disposed beneath said third frame; and a rotary platform disposed atop said base members and beneath said third frame.

2. The machine according to claim 1, wherein said third frame includes a first end and an opposite second end, with each said end respectively including first and second momentary strip retention means disposed thereon.

3. The machine according to claim 2, wherein each said strip retention means comprises a pneumatically actuated, arcuately moving mechanism.

4. The machine according to claim 1, including drive means for laterally reciprocating said second frame on said first frame, moving said third frame vertically on said second frame, and reciprocating said guide along said third frame.

5. The machine according to claim 4, wherein said drive means for reciprocating said second frame on said first frame and moving said third frame on said second frame respectively include threaded lateral and vertical shafts with cooperating threaded engagement means respectively for said second and said third frame.

6. The machine according to claim 4, wherein said drive means for reciprocating said guide along said third frame includes a rolling ring drive.

7. The machine according to claim 4, wherein said drive means for reciprocating said second frame on said first frame, moving said third frame on said second frame, and reciprocating said guide along said third frame each include electric motor power means.

8. The machine according to claim 1, including limit switch means for limiting movement of said second frame, said third frame, and said guide.

9. The machine according to claim 1, including strip feeding means comprising opposed first and second pinch rollers disposed upon said guide, with each of said pinch rollers alternately rolling according to reciprocating movement of said guide for providing a downward pull upon a strip of material disposed therebetween.

10. The machine according to claim 1, including conveyor means for delivering strip material thereto.

11. A reciprocating stacking machine, comprising:

a stationary, generally vertically disposed first frame;

a generally vertically disposed, laterally reciprocating second frame extending from said first frame;

a vertically movable third frame extending generally horizontally from said second frame;

a longitudinally reciprocating guide supported by said third frame;

said first frame including generally horizontally disposed base members extending therefrom and disposed beneath said third frame;

a rotary platform disposed atop said base members and beneath said third frame; and conveyor means having an output end disposed generally above said guide, for delivering a continuous length of strip material through said guide for stacking.

12. The machine according to claim 11, wherein said third frame includes a first end and an opposite second end, with each said end respectively including first and second momentary strip retention means disposed thereon.

13. The machine according to claim 12, wherein each said strip retention means comprises a pneumatically actuated, arcuately moving mechanism.

14. The machine according to claim 11, including drive means for laterally reciprocating said second frame on said first frame, moving said third frame vertically on said second frame, and reciprocating said guide along said third frame.

15. The machine according to claim 14, wherein said drive means for reciprocating said second frame on said first frame and moving said third frame on said second frame respectively include threaded lateral and vertical shafts with cooperating threaded engagement means respectively for said second and said third frame.

16. The machine according to claim 14, wherein said drive means for reciprocating said guide along said third frame includes a rolling ring drive.

17. The machine according to claim 14, wherein said drive means for reciprocating said second frame on said first frame, moving said third frame on said second frame, and reciprocating said guide along said third frame each include electric motor power means.

18. The machine according to claim 11, including limit switch means for limiting movement of said second frame, said third frame, and said guide.

19. The machine according to claim 11, including strip feeding means comprising opposed first and second pinch rollers disposed upon said guide, with each of said pinch rollers alternately rolling according to reciprocating movement of said guide for providing a downward pull upon a strip of material disposed therebetween.

20. The machine according to claim 11, wherein said conveyor means is a roller conveyor.

* * * * *